United States Patent [19]

Schultes et al.

[11] 4,433,699

[45] Feb. 28, 1984

[54] SUNSHADE

[75] Inventors: Tilmann Schultes; Joachim Seidel, both of Solingen, Fed. Rep. of Germany

[73] Assignee: Kortenbach & Rauh Kommanditgesellschaft, Solingen, Fed. Rep. of Germany

[21] Appl. No.: 319,151

[22] Filed: Nov. 6, 1981

[30] Foreign Application Priority Data

Nov. 18, 1981 [DE] Fed. Rep. of Germany ..... 3043465

[51] Int. Cl.[3] ..... A45B 11/00; A45B 17/00

[52] U.S. Cl. ..... 135/20 R; 135/25 R; 135/98; 135/117

[58] Field of Search ..... 135/16, 20 A, 20 R, 135/98, 117, 25 R; 248/354 P, 354 S, 188.4, 418; 211/86; 160/134, 45, 53

[56] References Cited

U.S. PATENT DOCUMENTS

| | | | |
|---|---|---|---|
| 2,380,632 | 7/1945 | Cousino | 248/188.4 |
| 2,616,571 | 11/1952 | Griffin | 135/16 |
| 3,822,850 | 7/1974 | Elias | 248/354 S |
| 4,086,931 | 5/1978 | Hall | 135/20 A X |

FOREIGN PATENT DOCUMENTS

| | | | |
|---|---|---|---|
| 2050339 | 5/1971 | Fed. Rep. of Germany | 135/16 |
| 1077314 | 5/1953 | France | 248/354.1 |

*Primary Examiner*—Richard J. Apley
*Assistant Examiner*—Stephen R. Crow
*Attorney, Agent, or Firm*—Martin A. Farber

[57] ABSTRACT

A sunshade having a cover which can be folded together in fan-like manner and is supported by at least three support struts, at least the outer two support struts having one end pivoted to a bearing member which is swingable around at least one horizontal axis on a stand bar and can be locked in position thereon and the outer two support struts can be pivoted via a spreading slide by one spreading strut each, the spreading slide being displaceable and lockable on a central support strut which is fixed to the bearing member. In order to simplify handling even in case of larger dimensions, an adjustment bar is pivoted to the spreading slide by which adjustment bar the spreading slide can be displaced on the central support strut while the support struts are approximately parallel to the stand bar. On the central support strut there is pivoted an opening bar which is lockable to the stand bar at various positions for swinging the cover carried by the support struts around the horizontal axis of the bearing member. Instead of a separate adjustment bar, the opening bar can also be pivoted to the spreading slide and its lower end pivoted to a support slide which can be displaced and locked fast on the stand bar.

29 Claims, 9 Drawing Figures

SUNSHADE

The present invention relates to a sunshade having a covering which can be folded together in fan-like manner and which is supported by at least three support struts, one end of which is pivoted to a bearing member which is swingable around at least one horizontal axis on a stand bar and can be locked in position therein while the outer two support struts can be pivoted, each via a separate spreading strut by means of a spreading slide which is displaceable on the central support strut and can be locked in position on it.

Such fan-like sunshade devices are known in various embodiments. Their stand bar is either held by means of a clamping device in vertically adjustable manner in a socket of a standing base or stuck by means of a pointed tip directly into the ground when the sunshade is used in the garden. The covering of the sunshade, which is foldable in the manner of a fan, is spread out and folded together exclusively by means of the two outer support struts; the struts arranged between the outer support struts are swung upon the opening and closing movements exclusively by the covering to which they are fastened in suitable manner.

The spreading and folding of the outer support struts is effected in various manners in the known sunshades. In one known embodiment, a slide is fastened to an extension of the stand bar, referred to as the upper pole, the slide being connected with the outer supporting struts by yokes and swinging them in order to open and close the cover material of the sunshade. In two other embodiments, the inner ends of the support struts are swingably pivoted to a bearing member, the inner ends lying on a semicircle. The swinging of the two outer support struts is effected either via struts by means of a spreading slide which is arranged displaceably on a length of tube also arranged on the bearing member, or by tensioning bars acting in the manner of a toggle joint which are swingable via a handle with respect to the bearing member and can thus be varied in their total length. In order to secure the spread position of the fan-fold covering in this last-mentioned embodiment, the toggle-like parts of the tensioning bars must be brought beyond a dead-center position.

The known sunshades having a covering which is foldable in the manner of a fan all have the disadvantage that they are cumbersome and require a relatively large amount of force in order to open and close them, so that the size of their covering must not exceed a certain value inasmuch as otherwise it will no longer be possible for a single person to operate the sunshade or the sunshade will no longer have sufficient stability upon the opening or closing of its covering.

The object of the present invention is to further develop a sunshade of the aforementioned type having a covering which is foldable in fan shape in such a manner that the sunshade can be opened in simple fashion, requiring only a small amount of force, by merely one person, so that the size of its covering can be considerably increased as compared with the known sunshades and be of sufficient size to protect a medium-size terrace or balcony from the sun and possibly from the wind and rain.

This object is achieved by the invention in the manner that an adjustment bar is pivoted to the spreading slide, by which bar the spreading slide, with the support struts lying approximately parallel to the stand bar, is displaceable on the central support strut, to the latter there being pivoted an opening bar which can be locked to the stand bar for swinging the covering carried by the support struts around the axis of the bearing member.

The development in accordance with the invention provides the possibility of actuating the spreading slide with the support struts lying approximately parallel to the stand bar by means of the adjustment bar in a favorable position of the body and to spread or fold the covering when it is in a position in which it hangs approximately vertically downward. The operator can then grin the adjustment bar in a favorable position so that even in the case of very large sunshades the operation need not be carried out above one's head but can be carried out at chest level. The raising and lowering of the open protective roof is effected by the opening bar which is also arranged in such a manner that it can be conveniently gripped so that, as a whole, there is obtained a substantial facility of operation which makes the handling of even larger and heavier sunshades possible by only a single person.

In accordance with another feature of the invention the adjustment bar can be locked on the central support strut in a position extending parallel to it so that after spreading the covering open and extending or raising the opened protective roof, it is located in a position which does not interfere with the useful area or its esthetic appearance. The opening bar can, in accordance with the invention, be fastened at its lower end at different heights—for instance via a plurality of openings—to the stand bar so that any desired inclination of the opened protective roof can be obtained.

If, in accordance with a further development of the sunshade of the invention, the opening bar is pivoted to the spreading slide, it is then possible, dispensing with a separate adjustment bar, for the spreading slide to be actuated by the opening bar when the support struts bearing the covering hang down approximately parallel to the stand bar. The opening bar in this case serves on the one hand to spread the covering open in fan-like manner before it is swung into its desired position of use and, after the the opened covering is swung against the stand bar, and also to folding the cover together by actuation of the spreading slide.

This operation is facilitated if, in accordance with the invention, the pivot point of the opening bar on the spreading slide, when the covering is swung against the stand bar lies between the stand bar and a line which passes through the pivot point of the opening bar on the support slide and the swing axis of the bearing member. With this development of the sunshade of the invention there is obtained, upon actuation of the opening bar, first of all a spreading open of the covering before, by a slight lifting thereof. Further actuation of the opening bar produces a swinging of the opened covering into the specific position of use.

In order to achieve reliable stability even in the case of large sunshades without the stand bar having to be fastened in any manner, it is furthermore proposed by the invention for the stand bar to be developed in variable length for clamping between a base surface and an upper stop. This development of the stand bar in variable length makes an additional attachment to the body of the building superfluous, the latter on the one hand requiring a certain amount of skill and on the other hand making the place of erection invariable. The measures resulting from an additional attachment would not only result in damage to the body of the building but, in the case apartments would furthermore require the consent of the landlord or condominium management. Furthermore this clamping of the stand bar in accordance with the invention between a base surface and an upper stop makes it possible for the protective surface to be swung out beyond a balcony or terrace wall without the danger of the sunshade falling over.

If, in accordance with another feature of the invention, the bearing member for the support strut is arranged rotatably on or with the stand bar around the longitudinal axis of the latter, there is the possibility of turning the protective surface of the sunshade formed by the covering and the support struts in such a manner that it cannot only follow the travel of the sun but, when not used, can be so turned that it is stored horizontally in a spread-open or folded condition, in particular below the floor of the balcony located above it. In this way, there is obtained the possibility of storing the sunshade of the invention in a manner which protects it from the weather and furthermore is esthetically attractive.

In order to increase the steadiness of the sunshade and be able to take up thermal expansions on the part of the building, it is proposed by the invention that the stand bar be clamped elastically between the base surface and the stop. For this purpose, a rubber element can be arranged at the upper and/or lower end of the stand bar.

In a preferred embodiment of the invention, the stand bar comprises a main tube provided on its upper end with the bearing member, and a stand tube which is supported displaceably on the main tube. In this way the possibility is obtained of changing the length of the stand bar telescopically, the main tube and the stand tube being adapted to be adjustably connected to each other by a bolt and a series of holes in order to effect the rough adjustment of the desired length. The fine adjustment is effected in accordance with the invention by a threaded sleeve fastened to the lower end of the stand bar, a threaded pin which rests on the base surface engaging in the sleeve.

In order, on the one hand, to increase the base resting surface of the sunshade and, on the other hand, to make it possible to turn the entire stand bar around its longitudinal axis, the threaded pin, in accordance with another feature of the invention, rests turnably on a stand base. The stand bar which rests via the stand base in rotatable manner on the floor surface can furthermore be locked in a non-rotatable manner by a set screw mounted on the stand bar which acts on the stand base or by a locking pin which engages into holes in the stand base so that the sunshade is securely held in each case in the desired position. The locking pin may be removable and used at the same time as a lever for actuating the threaded pin so as to clamp the stand bar in position.

A particularly simple and economical embodiment with respect to the upper swivel joint for the protective surface formed by the covering and the support struts is obtained when the bearing member is mounted swingable around a horizontal pin, on a supporting member which is developed as a resting surface for a bearing ring which is guided on a pivot pin and bears a rubber bushing. In this way there is obtained at the same time a simple development of the upper bearing which on the one hand, permits turning of the stand bar around its longitudinal axis and on the other hand the clamping thereof between the floor and an upper abutment.

The support struts are fastened in a suitable manner to the fan-fold cover, preferably by being they are inserted into pockets on the bottom of the cover. In order to compensate for unavoidable tolerances, spring-biased end pieces can be arranged in the ends of the support struts in accordance with the invention.

It is also proposed by the invention that the spreading slide, in the end position thereof which fully spreads the cover, be fixed in complementary form-lock manner on the support strut by means of a locking member which can be opened by a handle against the force of a spring. In this way there is obtained an automatic engagement of the spreading slide in the spread position of the cover, which has the advantage over the frictional fixing of the spreading slide in position that upon each opening, the end position is reliably reached, which position, on the other hand, can be released again by simply actuating the handle in order to fold the cover together.

With the above and other objects and advantages in view, the present invention will become more clearly understood in connection with the detailed description of preferred embodiments, when considered with the accompanying drawings, of which:

Figure 1:
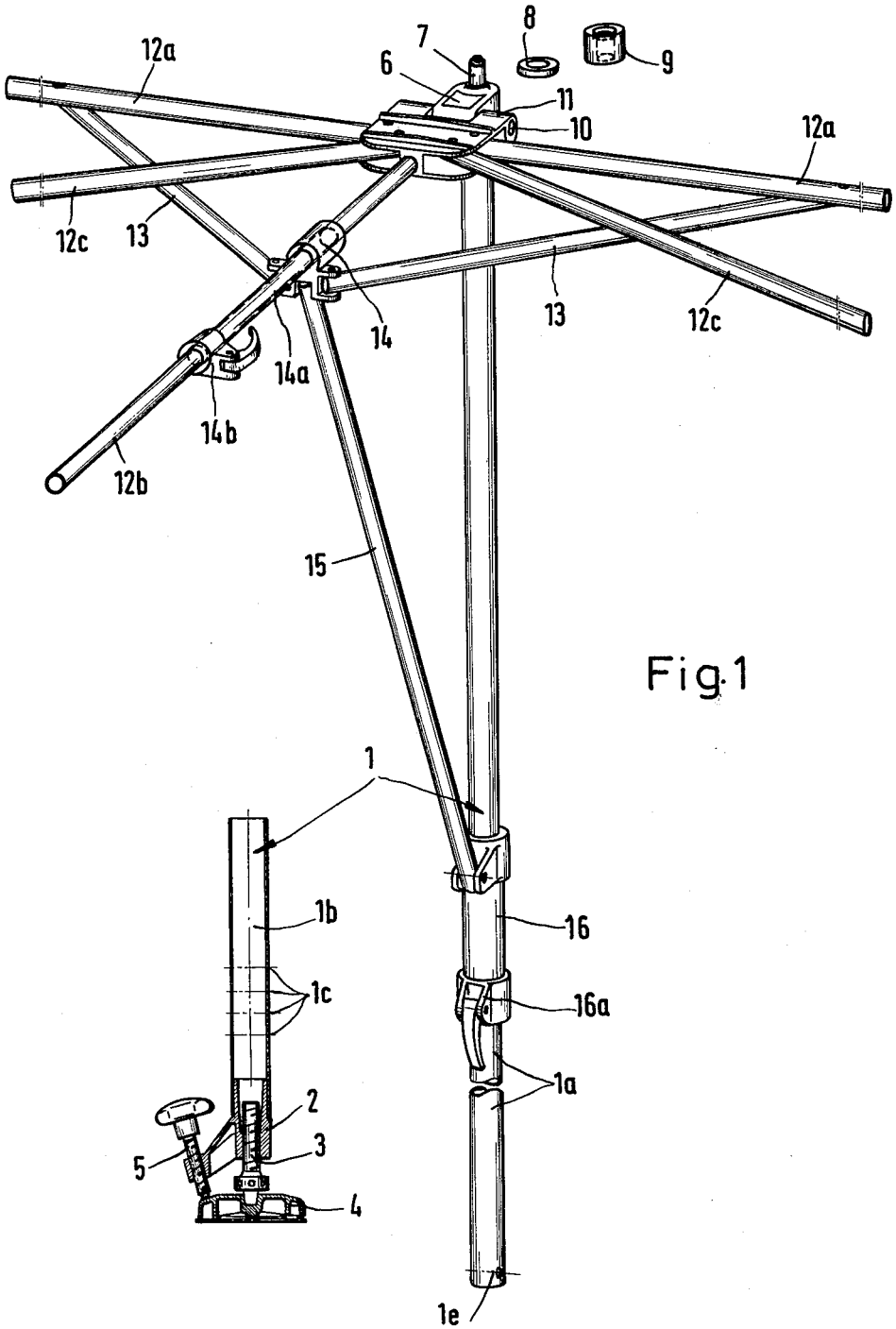
FIG. 1 is a perspective view partially exploded of a first embodiment of an opened shade frame with the stand bar shown alongside of it, seen in longitudinal section.

The sunshade shown in accordance with the embodiment of FIGS. 1 to 4 has a stand bar 1 which comprises a main tube 1*a* and a stand tube 1*b* (compare FIG. 5 and the lower separate sectional view of FIG. 1), which tubes are telescopically connected to each other in order to change the length of the stand bar 1. The stand tube 1*b* which has the smaller diameter and extends into the main tube 1*a* has a row of holes 1*c*. A pin 1*d* can be inserted in any one of the holes of this row of holes 1*c*, the pin being adapted to be pushed through a transverse hole 1*e* in the lower end of the main tube 1*a*. In this way a rough adjustment of the desired length of the stand bar 1 can be obtained.

A threaded sleeve 2 is fastened to the lower end of the stand tube 1*b*, into which sleeve a threaded pin 3 is screwed. This threaded pin 3 which is developed with surfaces for the action of an actuating device, for instance transverse holes 1*e*, rests rotatable at its lower end on a stand base 4 which rests a via a large area on the floor B for instance of a balcony. Due to the turnable mounting of the threaded pin 3 in the stand base 4 the entire stand bar 1 can be turned with respect to the stand base 4 around the longitudinal axis of the stand bar 1 while maintaining the fine adjustment which has been effected by the threaded sleeve 2 and the threaded pin 3 in order to clamp the stand bar 1 between the floor B and an upper abutment A. This upper stop A (FIGS. 3–4) can, for instance, be the bottom side of another balcony. In order to be able to hold the stand bar 1 fast in the desired position of rotation, a set or fastening screw 5 which acts on the stand base 4 is arranged on the threaded sleeve 2.

At the upper end of the main tube 1*a* there is fastened a support member 6 from which a pivot pin 7 protrudes upwardly. This pivot pin 7 serves to receive a bearing ring 8 which rests on the support mem 6, as well as a rubber bushing 9. These parts form the upper rotary bearing for the stand bar 1, the rubber bushing 9 at the same time providing a resilient clamping of the stand bar 1 between the upper stop A and the floor B, which serves, inter alia to compensate for thermal expansion on the part of the building.

A bearing member 11 is swingably supported on the support member 6 by means of a horizontally arranged bearing pin 10, a total of five support struts 12*a*, 12*b*, 12*c* being arranged on said bearing member in the embodiment shown in the example. While the central support strut 12*b* is arranged fixed in position on the bearing member 11, the outer support struts 12*a* as well as the intermediate support struts 12*c* are pivoted relative to the bearing member 11 in the manner of a fan. The support struts 12*a*, 12*b* and 12*c* together bear a sunshade cover, not shown in the drawing, for instance in the manner that said struts are inserted into pockets in said cover.

The fan-like spreading or folding together of this cover (which has not been shown in order to provide a better view) is effected by two spreading struts 13 each of which is displaceably pivoted at one of its ends to an outer support strut 12*a* and at the other end to a spreading slide 14. This spreading slide 14 is displaceably mounted on the central support strut 12*b* and has a tubular extension 14*a* with a clamping device 14*b* so that it can be locked fast on the central support strut 12*b* in any desired position. Displacement of the spreading slide 14 on the central support strut 12*b* thus causes a swinging of the outer supporting struts 12*a* and, via the cover, also of the intermediate support struts 12*c* so that the protective surface of the sunshade formed by the cover and the support struts 12*a*, 12*b*, 12*c* can be spread or folded together in fan-like fashion by means of the spreading slide 4. The spread position can be noted in front view in FIG. 2 and the folded position can be noted in side view in FIG. 3.

In order to change the angular position with respect to the stand bar 1, of the protective surface which is swingably mounted on the main tube 1*a* for swinging around the bearing pin 10 and to be able to lock it fast in any desired position, an opening bar 15 is provided, the upper end of which is pivoted to the spreading slide 14 while its lower end is pivoted to a support slide 16 which in its turn is displaceable on the main tube 1*a* and can be locked in any desired position by means of a clamping device 16*a*. By the arrangement of the upper end of the opening bar 15 on the spreading slide 14, this opening bar 15 is at the same time intended to effect a spreading or folding together of the support struts 12*a*, 12*b*, 12*c* when the protective surface is vertical (that is hanging down as shown in solid lines in FIG. 3) since a displacement of the support slide 16 on the main tube 1*a*, when the clamping device 14*b* is open, results in an actuation of the spreading slide 14.

Figure 2:
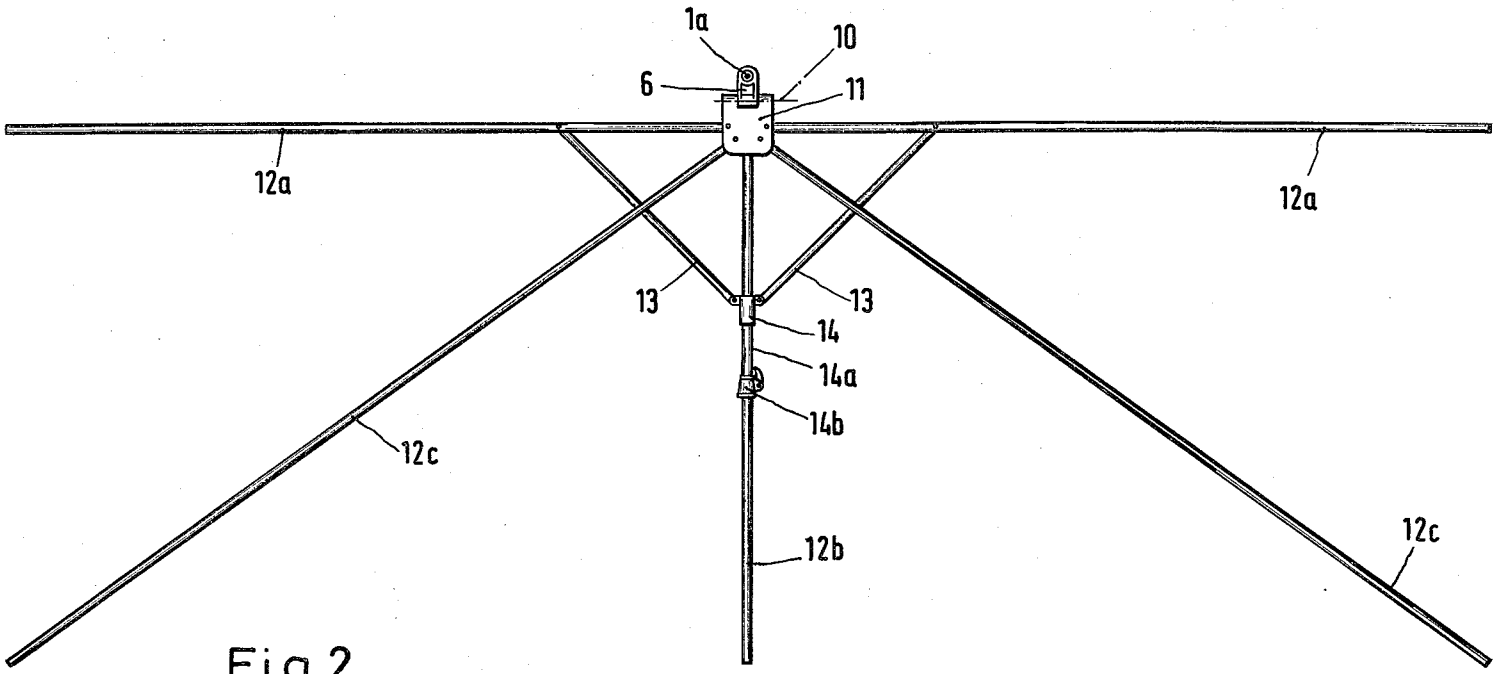
FIG. 2 is a top view of the open sunshade of FIG. 1.
Figure 3:
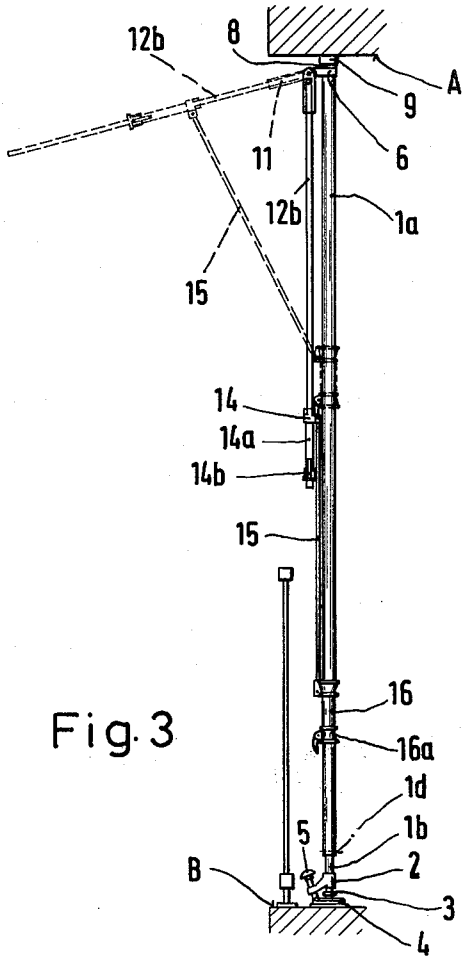
FIG. 3 is a side view of the sunshade arranged on a balcony, the support struts being shown in solid lines in the vertically downward hanging position and in dashed lines in a position of use.

FIG. 2 shows that despite the use of a total of only five support struts 12*a*, 12*b*, 12*c* a relatively large protective surface is obtained, which surface as shown in FIG. 3, can be swung into any desired position with respect to the stand bar 1 by means of the opening bar 15. Via the opening bar 15, the fan-like spreading out of the support struts 12*a* and indirectly also of the support struts 12*b* can, with the clamping device 14*b* loosened, be effected when the support slide 16 is pushed upwardly on the main tube 1*a* into the position shown in dashed lines in FIG. 3. In this way the opening bar 15, via the spreading slide 14 guided on the central support strut 12*b* and the spreading struts 13 pivoted to it, spreads the outer support struts 12*a* so that the support slide 16 which lies in a favorable operating position can also be used for the opening and closing of the protective surface formed of the cover and the support struts 12*a*, 12*b*, 12*c*. After locking the spread opened protective surface by clamping the spreading slide 14 by means of the clamping device 14*b* on the central support strut 12*b* there then takes place a swinging of the open protective surface via the opening bar 15 so that the position of use of the sunshade shown in dashed line in FIG. 3 is obtained.

Figure 4:
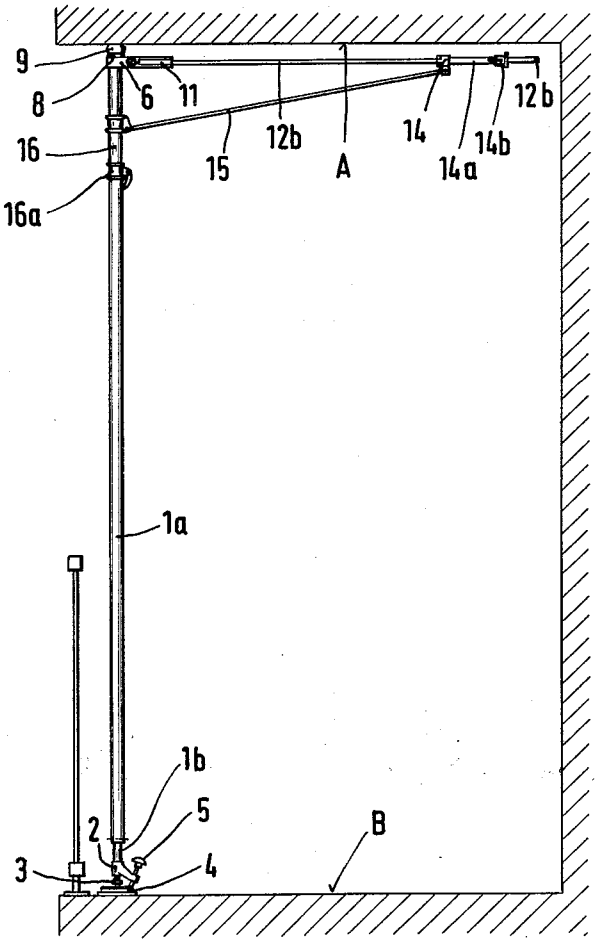
FIG. 4 is a side view corresponding to FIG. 3 in which the opened protective surface has been swung in under the upper balcony.

When the protective surface is to be stored protected from the elements when not in use, there is the possibility, as a result of the rotatable mounting of the stand bar 1, either to store the opened protective surface or else the folded protective surface in a protected manner below the upper balcony in the manner shown in FIG. 4. For this purpose it is merely necessary to loosen the fastening screw 5 on the threaded sleeve 2 and to swing the entire stand bar 1 around its longitudinal axis in such a manner that it assumes the position shown in FIG. 4, in which the opened protective surface is located below the balcony. In this way one obtains not only a compact but also an attractive storage, protected from the influence of the weather and in which only the stand bar 1 is within the field of view of the user of the balcony, while the opened protective surface forms a sort of ceiling covering for the balcony.

Figure 5:
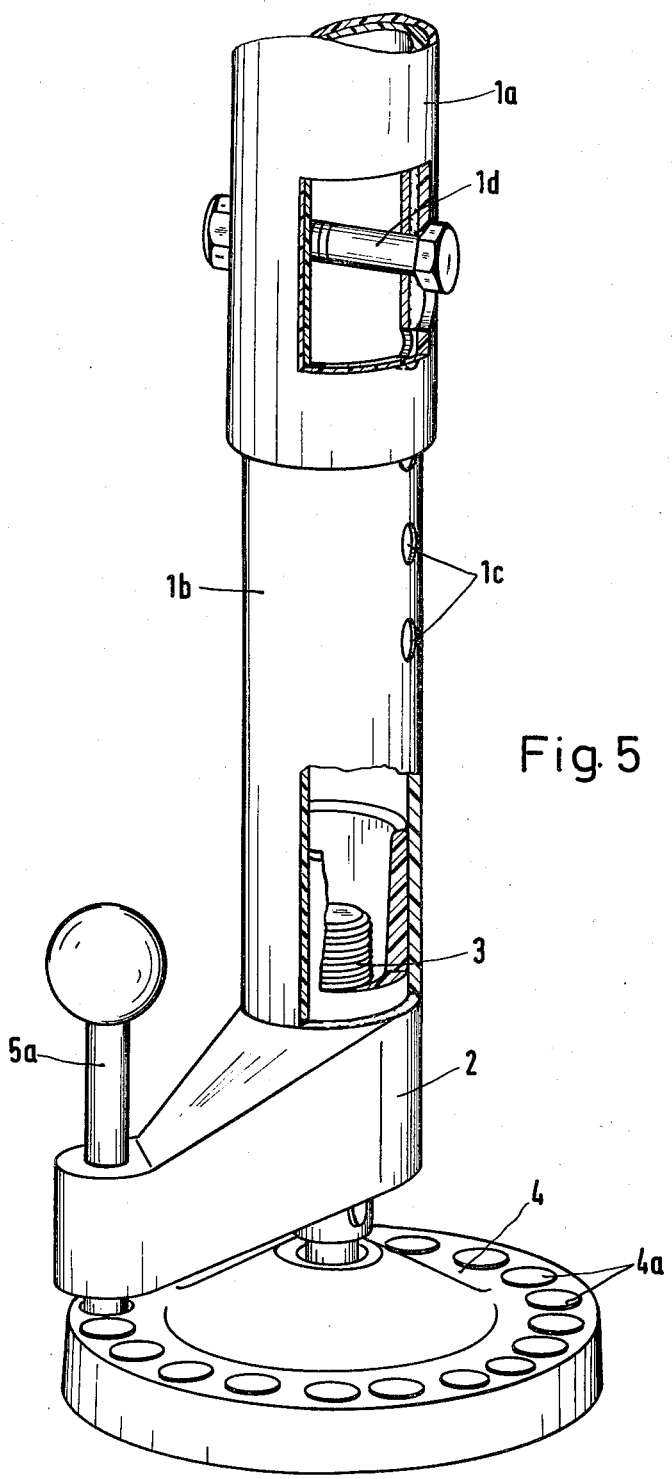
FIG. 5 is an alternative embodiment for the stand base.

FIG. 5 shows an another embodiment for the stand base 4. For the non-rotatable securing of the stand bar 1, the base is provided on its periphery with a plurality of holes 4*a* into which a locking pin 5*a* which can be inserted into an extension of the threaded sleeve 2 engages from above. This locking pin 5*a* can at the same time be used to actuate the threaded pin 3 since it can be pulled out upwards from the extension of the threaded sleeve 2 and can be inserted into the radial holes (unnumbered in FIGS. 1 and 5) of the threaded pin 3.

Figure 6:
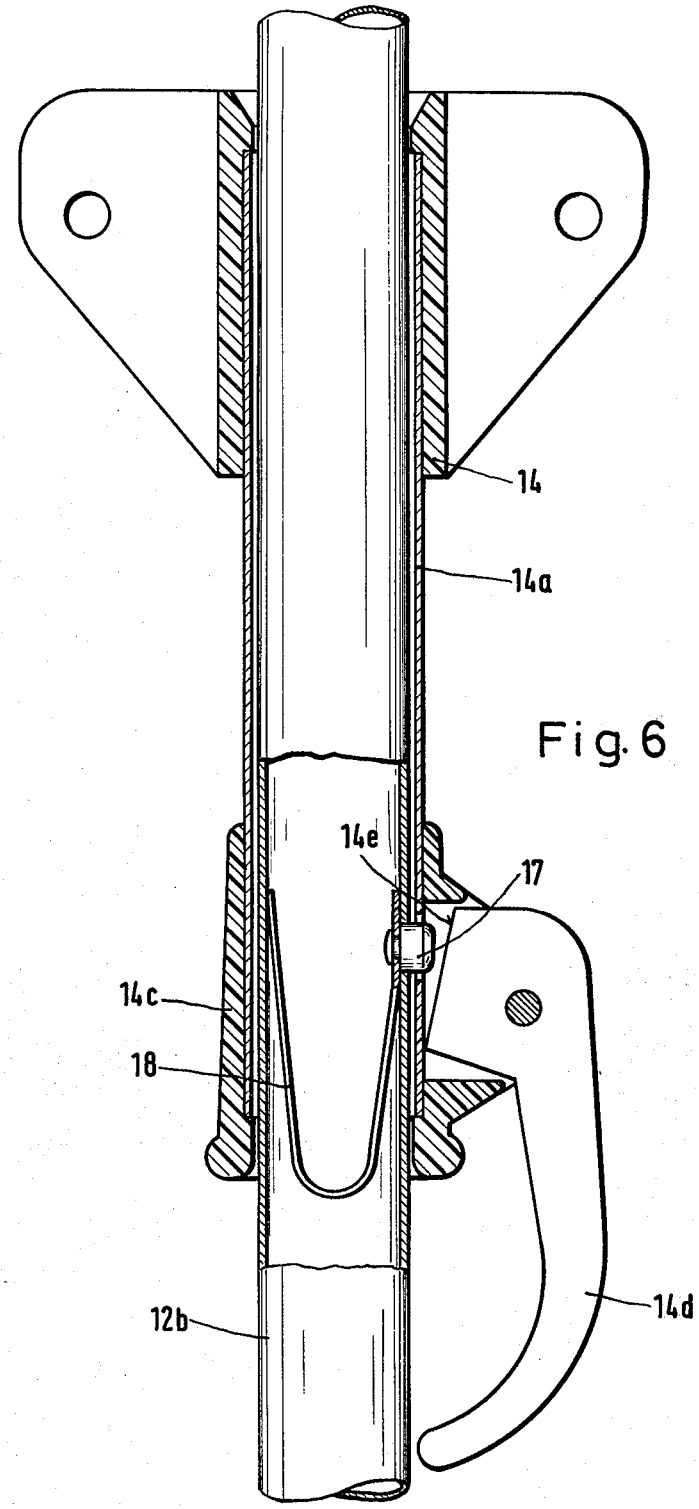
FIG. 6 is a preferred embodiment of the spreading slide shown in longitudinal section.

Instead of the above-mentioned force-lock fastening of the spreading slide 14 on the central supporting strut 12*b*, a fastening by a complementary form engagement of cooperating members can also be effected in the upper end position of the spreading slide 14, as shown in FIG. 6. In this embodiment, a sleeve 14*c* is arranged on the end of the tubular extension 14*a* of the spreading slide 14, a handle 14*d* being swingably mounted on said sleeve 14*c*. This handle 14*d* has a push surface 14*e* which cooperates with a locking member 17 which is arranged in a hole in the central support strut 12*b* and is fastened to the end of a spring 18. This button-like locking member 17 engages into a hole in the tubular extension 14*a* of the spreading slide 14 when the latter is in its end position in which it spreads the cover. For folding the cover together the locking member 17 can, by swinging the handle 14*d*, be forced back into the inside of the central support strub 12*b* until the complementary engagement of the locking member 17 in the hole of the extension 14*a* is eliminated and the spreading slide 14 can be displaced by the opening bar 15 (not shown in FIG. 6). The embodiment described in FIG. 6 thus automatically produces a complementary form-lock securing of the spreading slide 14 in its upper end position and at the same time creates the possibility of eliminating this fastening by simply swinging the handle 14*d* when the cover is to be folded together in fanlike manner.

Figure 7:
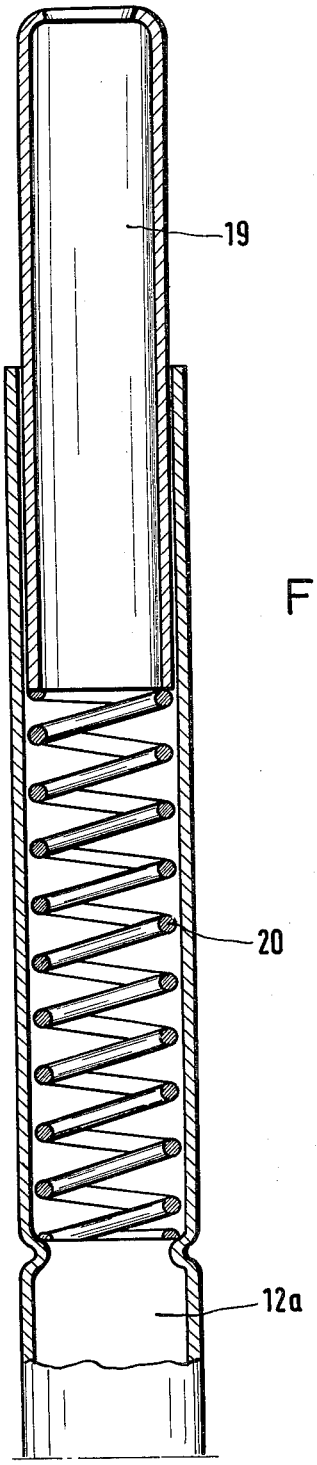
FIG. 7 is a longitudinal section through the end of a support strut provided with a spring-actuated end piece.

In order to compensate for tolerances, such as are unavoidable particularly with large dimensions of the cover, and to obtain a taut and attractive fit of the cover on the support, struts 12*a* and 12*b*, and end pieces 19 which are acted on by a compression spring 20 can, as shown in FIG. 7, be arranged in the ends of the support struts 12*a*, 12*b*, 12*c*. This compression spring rests at its outer end against the end surfaces of the end piece 19 and at its inner end against lateral indentations in the corresponding support struts 12*a*, 12*b*, 12*c*, as is shown in FIG. 7.

Figure 8:
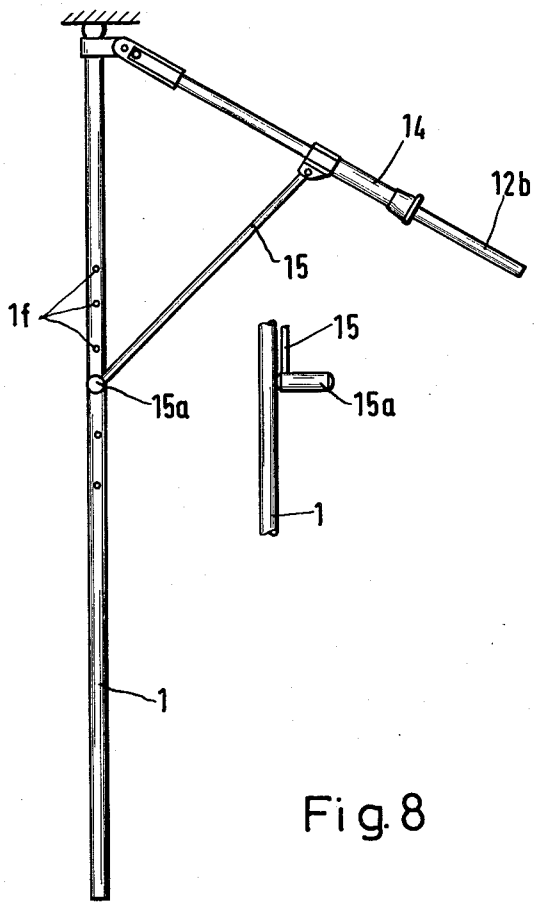
FIG. 8 shows one simple possibility for fastening the opening bar to the stand bar.

FIG. 8 shows, in diagrammatic side and rear broken away views, an embodiment of the sunshade in which the opening bar 15, whose upper end is pivoted to the spreading slide 14 can be locked at its lower end at different heights on the stand bar 1 in the manner that a pin arranged on a handle 15*a*, the pin engaging into one of several openings 1*f* which are arranged laterally in the stand bar 1. This embodiment provides a particularly simple development for a complementary form-lock attachment of the lower end of the opening bar 15 to the stand bar 1, while the use of a support slide 16 described in the embodiment in accordance with FIGS. 1 to 5 produces via clamping device 16*a* a force-lock clamping of the opening bar 15 to the stand bar 1. For clarity of illustration this Figure does not show the spreading struts 23 which act in the same manner as in the first described embodiment.

Figure 9:
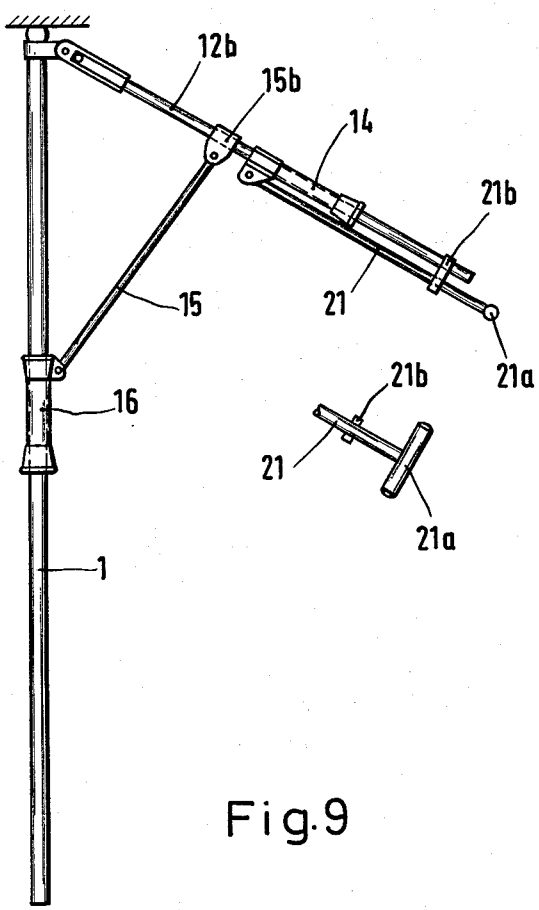
FIG. 9 shows an embodiment of the sunshade with a separate adjustment for the spreading slide.

Finally, FIG. 9 shows, in a diagrammatic side and top broken away views, the frame of a sunshade in which the opening bar 15 which is pivoted at its lower end to the support slide 16 is pivoted at its upper end via a clip 16*b* to a fixed point on the central support strut 12*b*. In this embodiment, an additional adjustment bar 21 which is pivoted to the spreading slide 14 serves to actuate the spreading slide 14 for the folding and unfolding of the cover as described in the previous described embodiments via the spreading struts 13 (not shown in FIG. 9). This adjustment bar 21 is provided at its lower end with a transverse grip 21*a*. When not used it can be fastened to the central support strut 12*b* parallel to the latter by a clamp 21*b* as shown in FIG. 9.

What is claimed is:

1. In a sunshade having a cover which can be folded together in fan-like manner and is supported by at least two support struts which are pivoted at one end to a bearing member, the latter being swingable on a stand bar around at least one horizontal axis and lockable thereon, and a spreading slide for pivoting an outer two of the support struts by means of a spreading strut, respectively, the spreading slide being displaceable and lockable on a central support strut which is connected to the bearing member, the improvement comprising means comprising an adjustment bar pivoted to the spreading slide, said adjustment bar means for displacing said spreading slide on said central support strut when said support struts lie approximately parallel to the stand bar, means comprising an opening bar being operatively pivoted to said central support strut, said opening bar being securable to the stand bar, said opening bar means for swinging the support struts around the horizontal axis of the bearing member.

2. A sunshade according to claim 1, wherein the adjustment bar is lockable on the central support bar in a position parallel to said central support bar.

3. A sunshade according to claim 1 or 22, further comprising means for securing a lower end of the opening bar to the stand bar at different heights.

4. A sunshade according to claim 3, wherein said securing means includes a plurality of holes formed in said stand bar and engagement means on said opening bar engageable into said holes, respectively.

5. A sunshade according to claim 1, wherein said opening bar simultaneously constitutes said adjustment bar, one end of said opening bar being pivoted to the spreading slide.

6. A sunshade according to claim 1 or 5, further comprising a support slide is displaceable and lockable on said stand bar, a lower end of the opening bar is pivoted to said support slide.

7. A sunshade according to claim 5, further comprising a support slide is displaceable and lockable on said stand bar, said opening bar at said one end thereof being pivoted to the spreading slide at a first pivot point, said opening bar is pivoted to said support slide at a second pivot point, said first pivot point lies between the stand bar and an imaginary line extending through said second pivot point and the horizontal axis of the bearing member when said support struts are in a position swung against and approximately parallel to the stand bar.

8. A sunshade according to claim 1, wherein the stand bar is variable in length being adapted for clamping between a floor surface and an upper abutment.

9. A sunshade according to claim 1, wherein the bearing member is turnably mounted on the stand bar around the longitudinal axis of the latter.

10. A sunshade according to claim 1, wherein the bearing member is turnably mounted jointly with the stand bar around the longitudinal axis of the latter.

11. A sunshade according to claim 1, including means for elastically clamping the stand bar between a floor surface and an abutment.

12. A sunshade according to claim 11, wherein said clamping means comprises a rubber element arranged on at least one of an upper and a lower end of the stand bar, respectively.

13. A sunshade according to claim 1, wherein the stand bar comprises a main tube and a stand tube relatively displaceably mounted in the main tube, said bearing member is arranged on the upper end of the main tube.

14. A sunshade according to claim 13, wherein means for displaceably connecting the main tube and the stand tube with one another comprising a pin disposed on one of said tubes, the other of said tubes is formed with a series of holes, said pin engaging in said holes, respectively.

15. A sunshade according to claim 13, wherein the stand tube includes, a threaded sleeve fastened at a lower end of the stand tube, means comprising a threaded pin for resting on a floor surface and engaging into said threaded sleeve.

16. A sunshade according to claim 13, wherein the stand tube includes, a threaded sleeve fastened at a lower end of the stand tube, and means comprising a threaded pin for engaging into said threaded sleeve, a stand base, the threaded pin is turnably supported on said stand base.

17. A sunshade according to claim 1, further comprising a stand base means for rotatably supporting the stand bar on a floor surface, a locking means mounted on said stand bar for non-rotatably locking said stand bar.

18. A sunshade according to claim 17, wherein said locking means is a locking screw.

19. A sunshade according to claim 17, wherein said locking means includes a locking pin mounted on said stand bar, said stand base means is formed with holes in which said locking pin engages.

20. A sunshade according to claim 1, further comprising a support member is fastened on said stand bar and is formed with a support surface having a pivot pin projecting upwardly therefrom, a horizontal bearing pin defining said horizontal axis is mounted on said support member, the bearing member is mounted rotatably around said bearing pin, a bearing ring is disposed on said pivot pin engaging said support surface, a rubber bushing is mounted on said bearing ring on said pivot pin.

21. A sunshade according to claim 1, wherein the support struts are fastened to the cover, the latter being foldable in fan-like manner by the pivoting of said at least two support struts on said bearing member.

22. A sunshade according to claim 21, wherein the support struts are inserted into pockets formed on the bottom side of the cover.

23. A sunshade according to claim 1, further comprising means comprising spring-biased end pieces arranged in ends of said support struts for equalization of tolerances.

24. A sunshade according to claim 1, wherein means including a spring for securing the spreading slide, in complementary form-lock manner with spring biased engagement, to the central support strut in an end position in which said spreading slide via said spreading struts fully spreads the cover, a handle means for releasing the form-locked, spring-biased engagement against the force of the spring.

25. The sunshade according to claim 24, wherein said central support strut is hollow, said spreading slide is tubular and coaxially displaceably mounted on said central support strut, said central support strut is formed with a first opening, said spreading slide is formed with a second opening alignable with said first opening, said spring is U-shaped and mounted in said central support strut having a locking member mounted on one end thereof and disposed in said first opening, said handle means is operatively engageable with said locking member.

26. In a sunshade having a cover which can be folded together in fan-like manner and is supported by at least two support struts which are pivoted at one end to a bearing member, the latter being swingable on a stand bar around at least one horizontal axis and lockable thereon, and a spreading slide for pivoting an outer two of the support struts by means of a spreading strut, respectively, the spreading slide being displaceable therefor and lockable on a central support strut which is connected to the bearing member, the improvement wherein said stand bar and said central support strut constitute parts, a clip fixed to at least one of said parts, bar means operatively associated with the spreading slide and with said central support strut via said clip for displacing said spreading slide on said central support strut when said support struts lie approximately parallel to the stand bar so as to pivot apart said outer two support struts and spread said cover and thereafter for swinging the support struts around the horizontal axis of the bearing member so as to lift said support struts and said cover, said bar means is lockable with respect to said stand bar and said central support strut respectively.

27. In a sunshade having a cover which can be folded together in fan-like manner and is supported by at least two support struts which are pivoted at one end to a bearing member, the latter being swingable on a stand bar around at least one horizontal axis and lockable thereon, and a spreading slide for pivoting an outer two of the support struts by means of a spreading strut, respectively, the spreading slide being displaceable therefor and lockable on a central support strut which is connected to the bearing member, the improvement comprising at least one bar means operatively pivoted to the spreading slide and to said central support strut for displacing said spreading slide on said central support strut when said support struts lie approximately parallel to the stand bar so as to pivot apart said outer two support struts and spread said cover and thereafter for swinging the support struts around the horizontal axis of the bearing member so as to lift said support struts and said cover, and said at least one bar means is lockable with respect to said stand bar and said central support strut respectively.

28. The sunshade as set forth in 27, wherein said at least one bar means constitutes two bars, one of said bars being pivoted with respect to said central support strut and displaceably lockable with respect to said stand bar, and the other of said bars being pivoted to said spreading slide and lockable with respect to said central support strut.

29. The sunshade as set forth in 27, wherein said at least one bar means constitutes a single bar pivoted to the spreading slide and displaceably lockable with respect to said stand bar, the spreading slide being displaceably lockable with respect to said central support strut so as to lock said bar with respect to said central support strut.

* * * * *